US009975003B2

(12) United States Patent
Molins et al.

(10) Patent No.: US 9,975,003 B2
(45) Date of Patent: May 22, 2018

(54) CONTROL SYSTEM FOR A TREADMILL INCLUDING A CONTROL UNIT AND A LASER DISTANCE SENSOR

(71) Applicant: Robert Bosch GmbH, Stuttgart (DE)

(72) Inventors: Jaime Adroher Molins, Madrid (ES); Balazs Jatekos, Budapest (HU)

(73) Assignee: ROBERT BOSCH GMBH, Stuttgart (DE)

( * ) Notice: Subject to any disclaimer, the term of this patent is extended or adjusted under 35 U.S.C. 154(b) by 0 days. days.

(21) Appl. No.: 15/345,642

(22) Filed: Nov. 8, 2016

(65) Prior Publication Data

US 2017/0128784 A1 May 11, 2017

(30) Foreign Application Priority Data

Nov. 10, 2015 (DE) ..... 10 2015 222 119

(51) Int. Cl.

| | |
|---|---|
| ***A63B 24/00*** | (2006.01) |
| ***A63B 22/02*** | (2006.01) |
| ***A63B 23/04*** | (2006.01) |
| *A63B 71/00* | (2006.01) |

(52) U.S. Cl.

CPC ..... *A63B 24/0087* (2013.01); *A63B 22/025* (2015.10); *A63B 23/0405* (2013.01); *A63B 2024/0093* (2013.01); *A63B 2071/0081* (2013.01); *A63B 2220/10* (2013.01); *A63B 2220/20* (2013.01); *A63B 2220/30* (2013.01); *A63B 2220/805* (2013.01)

(58) Field of Classification Search

CPC . A63B 24/00; A63B 24/0067; A63B 24/0082; A63B 22/025; A63B 22/02; A63B 22/0242; A63B 2220/10; A63B 2220/20; A63B 2220/30; A63B 2220/805; A63B 24/0087; A63B 23/0405; A63B 2024/0093; A63B 2071/0081

See application file for complete search history.

(56) References Cited

U.S. PATENT DOCUMENTS

| | | | | |
|---|---|---|---|---|
| 5,314,391 A | | 5/1994 | Potash et al. | |
| 5,368,532 A | | 11/1994 | Farnet | |
| 6,126,575 A | | 10/2000 | Wang | |
| 6,135,924 A | | 10/2000 | Gibbs et al. | |
| 6,152,854 A | * | 11/2000 | Carmein | A63B 22/025 198/779 |
| 7,094,180 B2 | | 8/2006 | Huang et al. | |
| 7,101,319 B1 | | 9/2006 | Potts | |
| 7,153,241 B2 | * | 12/2006 | Wang | A63B 22/0242 482/51 |

(Continued)

FOREIGN PATENT DOCUMENTS

CN 202277640 U 6/2012

*Primary Examiner* — Glenn Richman

(74) *Attorney, Agent, or Firm* — Norton Rose Fulbright US LLP; Gerard Messina

(57) ABSTRACT

A control system for a treadmill including a control unit and a laser distance sensor, the laser distance sensor being configured to determine the distance and/or the movement of a user relative to the laser distance sensor with the aid of a laser beam, the control unit being configured to control a movement of the treadmill as a function of measuring data of the laser distance sensor. A treadmill including such a control system is also described.

4 Claims, 2 Drawing Sheets

(56) References Cited

U.S. PATENT DOCUMENTS

| | | | | |
|---|---|---|---|---|
| 7,220,219 | B2 * | 5/2007 | Papadopoulos | A63B 22/02 482/54 |
| 7,713,172 | B2 * | 5/2010 | Watterson | A63B 22/0242 482/4 |
| 7,985,164 | B2 * | 7/2011 | Ashby | A63B 22/02 434/247 |

* cited by examiner

CONTROL SYSTEM FOR A TREADMILL INCLUDING A CONTROL UNIT AND A LASER DISTANCE SENSOR

CROSS REFERENCE

The present application claims the benefit under 35 U.S.C. § 119 of German Patent Application No. DE 102015222119.9 filed on Nov. 10, 2015, which is expressly incorporated herein by reference in its entirety.

FIELD

The present invention relates to a control system for a treadmill including a control unit and a laser distance sensor.

BACKGROUND INFORMATION

Control systems for a treadmill including a control unit and different sensors are available.

U.S. Pat. No. 5,314,391 describes an ultrasonic distance meter which continuously measures the distance from the body of a user and adapts the speed of the treadmill accordingly. The ultrasonic sensor allows a distance measurement at a resolution of several centimeters.

U.S. Pat. No. 5,368,532 describes an automatic treadmill speed control system including two pressure sensors beneath the running surface for detecting the position of a user. U.S. Pat. Nos. 7,094,180 B2 and 7,101,319 describe similar approaches. These systems, however, require the use of a plurality of sensors beneath the treadmill to measure the position of the foot with sufficient accuracy and reliability. They are not able to directly measure the position of the body of the user.

U.S. Pat. No. 6,135,924 describes an automatic treadmill control system including an optical position sensor, an infrared sensor, and a calibration system.

U.S. Pat. No. 6,126,575 describes a treadmill control system including a self-retracting rope which is attached to the user. A sensor detects the retraction or extension of the rope and adjusts the treadmill speed accordingly to the running speed of the user.

A safety key or a safety clip, which is attached to the user with the aid of a safety rope and a clamp, is most common. If the user suddenly moves backward on the treadmill and the safety clip detaches, the treadmill is deactivated or an emergency braking is carried out. Such an approach is described in the China Patent No. CN202277640, for example.

SUMMARY

The present invention relates to a control system for a treadmill including a control unit and a laser distance sensor, the laser distance sensor being configured to determine the distance and/or the movement of a user relative to the laser distance sensor with the aid of a laser beam, the control unit being configured to control a movement of the treadmill as a function of measuring data of the laser distance sensor.

One advantageous embodiment of the present invention provides that the laser distance sensor is designed for phase position measurement.

One advantageous embodiment of the present invention provides that the laser distance sensor includes a one-dimensional scanner for deflecting the laser beam in a first direction y, in particular for the horizontal deflection.

One advantageous embodiment of the present invention provides that the laser distance sensor includes a two-dimensional scanner for deflecting laser beam 25 in a first direction y and in a second direction z, in particular for the horizontal and vertical deflection.

The present invention also relates to a treadmill including such a control system, the laser distance sensor being configured in such a way that the laser beam is directable generally anti-parallel to the moving direction of the treadmill.

Features of the control system according to the present invention include the following:

The measuring accuracy of the laser distance sensor is several millimeters at a maximum range of approximately 50 cm. This measuring accuracy offers an approximately ten times better resolution of the position of the user than above-described systems in the related art.

The laser distance sensor has a low sensitivity with respect to noise, such as ambient light. In this way, reliable measurements under almost any condition in interior spaces are possible.

The control system according to the present invention is cost-effective to manufacture and easy to integrate into a treadmill.

The control system according to the present invention requires no calibration or maintenance. The measuring data are easy to process. Speed and position data may be obtained simultaneously.

In addition to the mere distance 1D, it is also possible to carry out 2D or 3D measurements with the aid of scanning. In this way, it is possible to reliably determine the position, movements, and body contour of a user. In this way, it is possible to identify emergency situations more quickly.

DETAILED DESCRIPTION OF EXAMPLE EMBODIMENTS

Figure 1:
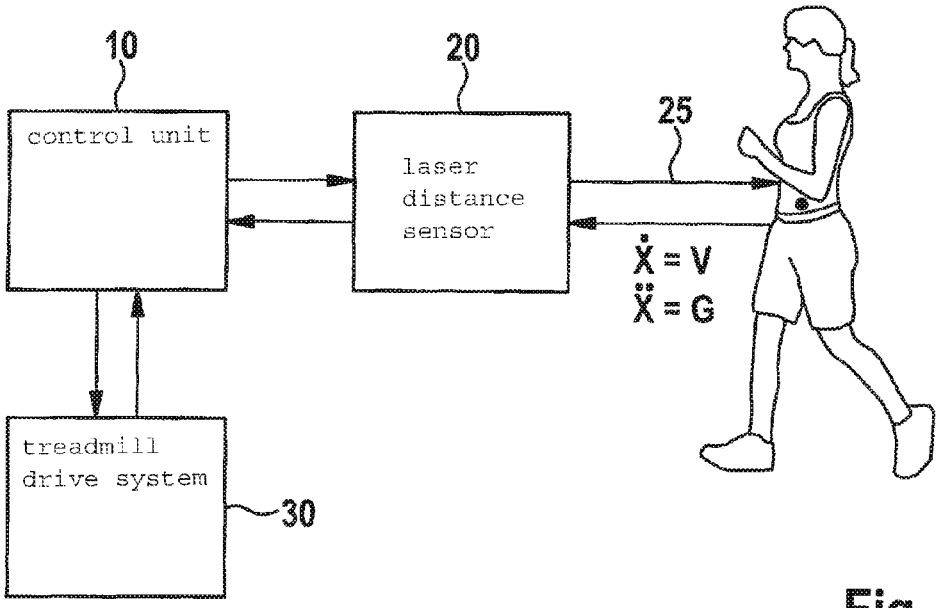
FIG. 1 schematically shows a control system according to the present invention for a treadmill including a control unit and a laser distance sensor.

FIG. 1 schematically shows a control system according to the present invention for a treadmill, including a control unit and a laser distance sensor. Shown are a control unit 10, a laser distance sensor 20, and a treadmill drive system 30. Laser distance sensor 20 is configured to determine distance x and/or the movement of a user, for example speed $v=dx/dt$ or acceleration $a=d^2x/dt^2$ of the user relative to laser distance sensor 20, with the aid of a laser beam 25. Control unit 10 is configured to control a movement of the treadmill as a function of measuring data of laser distance sensor 20. In this example, the laser distance sensor is configured to determine distance x or the movement of an object with the aid of phase position measurement. In this way, a one-dimensional measurement, namely of distance X from the object or user, is possible.

Figure 2:
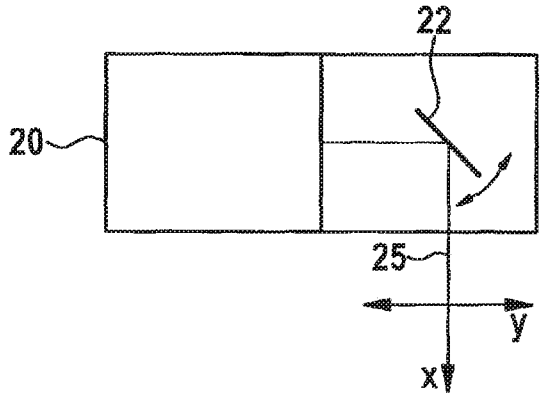
FIG. 2 schematically shows a laser distance sensor including a 1D scanner.

FIG. 2 schematically shows a laser distance sensor including a 1D scanner. Shown is a laser distance sensor 20, which emits a laser beam 25. Laser beam 25 is deflected by a one-dimensional scanner 22. One-dimensional scanner 22 includes a movable mirror which is tiltable in one direction so that laser beam 25 may be deflected in a first direction y. In this way, a two-dimensional measurement, namely of distance x from the object or user, spatially resolved in first direction y, is possible.

Figure 3:
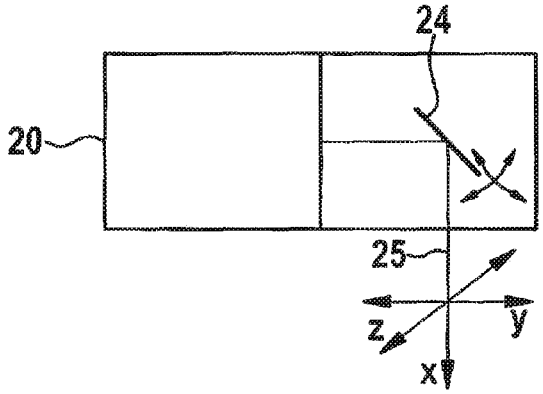
FIG. 3 schematically shows a laser distance sensor including a 2D scanner.

FIG. 3 schematically shows a laser distance sensor including a 2D scanner. Shown is a laser distance sensor 20, which emits a laser beam 25. Laser beam 25 is deflected by a two-dimensional scanner 24. Two-dimensional scanner 24 includes a movable mirror which is tiltable in two directions so that laser beam 25 may be deflected in a first direction y and in a second direction z. In this way, a three-dimensional measurement, namely of distance x from the object or user, spatially resolved in first direction y and second direction z, is possible. Alternatively, two-dimensional scanner 24 includes a first movable mirror which is tiltable in a first direction and a second movable mirror which is tiltable in a second direction.

Figure 4:
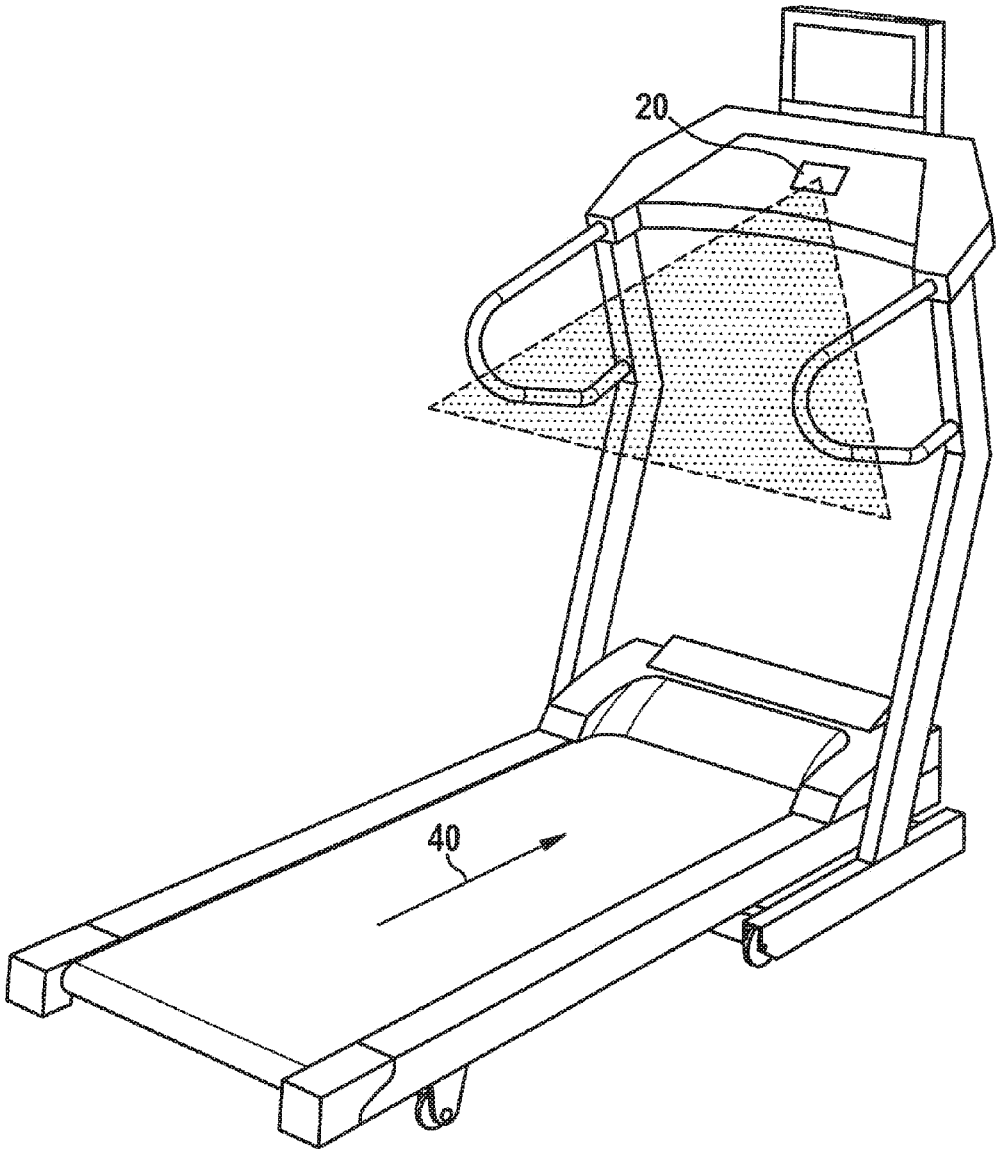
FIG. 4 schematically shows a treadmill including a control system according to the present invention including a laser distance sensor having a 1D scanner.

FIG. 4 schematically shows a treadmill including a control system according to the present invention including a laser distance sensor having a 1D scanner. Shown is a treadmill which is equipped with a control system according to the present invention, as described in FIG. 2. Laser distance sensor 20 is situated in the console and configured in such a way that laser beam 25 is directable essentially anti-parallel to the moving direction of the treadmill. In this way, it is possible to determine the distance of the user from the console of the treadmill. In addition, laser beam 25 is deflectable by one-dimensional scanner 22 in first direction y. In this way, it is possible to determine the position of the user on the treadmill transversely to the moving direction of the treadmill.

In another exemplary embodiment, not illustrated, the treadmill is equipped with a control system according to the present invention including a laser distance sensor according to FIG. 1. Laser distance sensor 20 is configured in such a way that laser beam 25 is directable essentially anti-parallel to the moving direction of the treadmill. In this way, it is possible to determine the distance of the user from the console of the treadmill.

In another exemplary embodiment, not illustrated, the treadmill is equipped with a control system according to the present invention including a laser distance sensor having a 2D scanner according to FIG. 3. Laser distance sensor 20 is configured in such a way that laser beam 25 is directable essentially anti-parallel to the moving direction of the treadmill. In this way, it is possible to determine the distance of the user from the console of the treadmill. In addition, laser beam 25 is deflectable by two-dimensional scanner 24 in first direction y, in this example in parallel to the treadmill surface. In this way, it is possible to determine the position of the user on the treadmill transversely to the moving direction of the treadmill. Moreover, laser beam 25 is deflectable by two-dimensional scanner 24 in second direction z, in this example perpendicular to the treadmill surface. In this way, it is possible to determine the position of the user on the treadmill in the form of a height above the treadmill surface.

In one specific embodiment of the present invention, a laser distance sensor, which is designed for phase position measurement, is situated in the area of the console of the treadmill. The laser beam is oriented at the position of the user horizontally above the treadmill. Due to the measuring principle, the sensor requires no calibration and simultaneously supplies data about the distance and relative speed of the detected object, i.e., of the user. The speed does not initially have to be derived from a measured change of the distance, i.e., from multiple consecutive distance measurements. This allows a shorter response time in emergency situations, and also a better determination of the user position and the movement relative to the sensor, and thus also to the treadmill.

The control system according to the present invention may carry out 1D, 2D or 3D measurements with the aid of the laser distance sensor. It determines the instantaneous distance and the speed of a user.

In the case of a one-dimensional measurement 1D, it is useful to determine the position of a point of the body surface of the user along the moving direction of the treadmill. The laser beam of the laser distance sensor is oriented in parallel to the moving direction of the treadmill for this purpose.

In the case of a two-dimensional measurement 2D, the position of the user along the moving direction and along vertical or horizontal lines in relation to the treadmill are determined.

In the case of a three-dimensional measurement 3D, the shape and the position of the torso or of the entire body of the user is determined. With the aid of the planar scanning, the profile of the entire projection surface is thus measured to a certain extent.

If the measuring data of the laser distance sensor indicate that the user has disappeared, is moving backward, is moving away or if any other sudden change in his or her position occurs during operation which may be interpreted as an emergency situation, the control system according to the present invention activates an emergency braking of the treadmill in an emergency operating state. In this way, a possible accident is to be prevented, or possible injuries occurring as a result are to be minimized.

Moreover, in a controlled operating state, the control system according to the present invention adapts the speed of the treadmill when it is established that the user is changing his or her running speed and exceeds certain predetermined limits in the process. The speed of the treadmill is adapted in such a way that the user essentially remains in a fixed position while running on the treadmill. Correspondingly, the speed of the treadmill is increased when the control system establishes that the user is situated too close to the operating console (front part of the treadmill). Conversely, the speed of the treadmill is decreased when the control system establishes that the user is situated too far away from the laser distance sensor, and thus is located at the rear end of the treadmill.

It is not only possible to utilize the control system according to the present invention for a treadmill, but also for any other machine in which it is useful to provide an emergency brake or emergency measure in another manner when during its operation the presence or absence of a user could constitute an emergency situation.

The control system according to the present invention may also be configured as a safety system for a treadmill. This safety system may be activated by a user, for example. For this purpose, the user may establish certain release conditions for the treadmill before it is used. For example, it could be impossible to put the treadmill into operation when nobody is situated thereon. Such a release condition may prevent accidents, for example, in which a person steps onto or jumps onto a treadmill which is already moving and then fall.

It is also possible to keep children who are too small from using the treadmill in that the control system does not detect a user at a certain minimum height above the treadmill, i.e., for a minimum body height, and thus does not release the treadmill for use. Such a functionality is particularly easy to implement with 2D and 3D scanning laser distance sensors.

What is claimed is:

1. A control system for a treadmill, comprising:

a control unit; and a laser distance sensor configured to determine at least one of a distance and a movement of a user relative to the laser distance sensor with the aid of a laser beam;

wherein the control unit is configured to control a movement of the treadmill as a function of measuring data of laser distance sensor, wherein the laser distance sensor is designed for phase position measurement.

2. The control system as recited in claim 1, wherein the laser distance sensor includes a one-dimensional scanner for deflecting the laser beam in a first direction y for a horizontal deflection.

3. The control system as recited in claim 1, wherein the laser distance sensor includes a two-dimensional scanner for deflecting the laser beam in a first direction y and in a second direction z, for a horizontal deflection and a vertical deflection, respectively.

4. A treadmill, including a control system, the control system having a control unit, and a laser distance sensor configured to determine at least one of a distance and a movement of a user relative to the laser distance sensor with the aid of a laser beam, wherein the control unit is configured to control a movement of the treadmill as a function of measuring data of laser distance sensor, wherein the laser distance sensor is configured in such a way that the laser beam is directable anti-parallel to a moving direction of the treadmill, wherein the laser distance sensor is designed for phase position measurement.

* * * * *